US008610660B2

(12) United States Patent
Xu et al.

(10) Patent No.: US 8,610,660 B2
(45) Date of Patent: Dec. 17, 2013

(54) LIGHT EMITTING DIODE BACKLIGHT DRIVING CIRCUIT

(75) Inventors: Ming Xu, Nanjing (CN); Shaobin Zhang, Shaanxi Province (CN)

(73) Assignees: FSP-Powerland Technology Inc., Nanjing (CN); FSP Technology Inc., Taoyuan County (TW)

( * ) Notice: Subject to any disclaimer, the term of this patent is extended or adjusted under 35 U.S.C. 154(b) by 368 days.

(21) Appl. No.: 13/183,467

(22) Filed: Jul. 15, 2011

(65) Prior Publication Data

US 2012/0013261 A1 Jan. 19, 2012

(30) Foreign Application Priority Data

Jul. 16, 2010 (CN) ..... 2010 1 0232587

(51) Int. Cl.
*G09G 3/36* (2006.01)
*H05B 37/02* (2006.01)

(52) U.S. Cl.
USPC ..... 345/102; 315/213; 315/216; 315/217; 315/220; 315/221; 315/291

(58) Field of Classification Search
USPC ..... 345/102; 315/209 R, 210, 212, 213, 315/216, 217, 219, 220, 221, 291, 299
See application file for complete search history.

(56) References Cited

U.S. PATENT DOCUMENTS

| | | | | |
|---|---|---|---|---|
| 8,432,104 | B2 * | 4/2013 | Hu et al. | 315/282 |
| 2009/0195169 | A1 * | 8/2009 | Huang et al. | 315/193 |
| 2010/0148679 | A1 * | 6/2010 | Chen et al. | 315/185 R |
| 2010/0214210 | A1 * | 8/2010 | Aso et al. | 345/102 |

* cited by examiner

*Primary Examiner* — Thuy Vinh Tran
(74) *Attorney, Agent, or Firm* — Jianq Chyun IP Office

(57) ABSTRACT

An LED backlight driving circuit including a boost circuit and a transformer current balance circuit is provided. The boost circuit provides a total current for n LED strings, and the transformer current balance circuit is coupled to the LED strings and includes n−1 transformers. A first LED current-balance-circuit (CBC) includes a switching-transistor connected to a secondary-winding of a first-transformer, and an $n^{th}$ LED CBC includes a switching-transistor connected to a primary-winding of an $(n-1)^{th}$ transformer. An $i^{th}$ ($1<i<n$, $n>2$) LED CBC includes a switching-transistor sequentially connected to a primary-winding of an $(i-1)^{th}$ transformer and a secondary-winding of an $i^{th}$ transformer. The passive-transformers are applied in the LED driving circuit to implement current balance/equalization, such that the LED backlight driving circuit is suitable for a system with any odd or even number (greater than 1) of the LED strings connected in parallel, so as to reduce the cost of the system.

3 Claims, 6 Drawing Sheets

LIGHT EMITTING DIODE BACKLIGHT DRIVING CIRCUIT

CROSS-REFERENCE TO RELATED APPLICATION

This application claims the priority benefit of China application serial no. 201010232587.0, filed Jul. 16, 2010. The entirety of the above-mentioned patent application is hereby incorporated by reference herein and made a part of this specification.

BACKGROUND OF THE INVENTION

1. Field of the Invention

The invention relates to a driving circuit, more particularly, to a light emitting diode (LED) backlight driving circuit with transformers for current balance in an LED driving field.

2. Description of Related Art

A backlight source of a conventional liquid crystal display (LCD) is mainly formed by cold cathode fluorescent lamps (CCFLs), though with development of light emitting diode (LED), since the LED has advantages of high light emitting efficiency, fast response speed, good color representation, long service life and none mercury, etc., in large panel applications such as an LCD TV, it has replaced the CCFLs and becomes a main backlight source.

In order to obtain enough brightness, a plurality of LEDs is connected in series for utilization. However, considering a specific power conversion and security, etc., the number of the LEDs of each LED string is generally limited, so that in an actual large size of LCD backlight application, the LEDs are generally connected in series to form LED strings first, and then the LED strings are connected in parallel to form an LED array. To unify the brightness of the whole LCD screen, each of the LED strings has to provide a same brightness. According to a characteristic of the LED, the brightness of the LED is proportional to a driving current thereof, and a small variation of a voltage difference between two ends of the LED may lead to a large variation of a current flowing through the LED. Therefore, to produce the constant brightness, a constant current control has to be performed to each LED string of the LED backlight source.

A typical structure of LED backlight source (shown in FIG. 1) is generally composed of three stages of circuits, where a first stage is a power factor correction (PFC) circuit, a second stage is a direct current (DC)-DC isolation converter, and a third state is an LED driving circuit. The conventional LED driving circuit is as that shown in FIG. 2. The LED driving circuit is used for driving the LED strings, and performing a current balance/equalization to each of the LED strings, so as to make each of the LCD strings have the same brightness.

An LED current balance circuit is generally implemented by active devices such as operational amplifiers, transistors, metal oxide semiconductor field effect transistors (MOSFETs), or a pulse width modulation (PWM) controller integrated by the above devices. When the LED current balance circuit composed of the active devices (shown in FIG. 3) performs current balance/equalization, a device conduction loss is huge, so that a heat dissipation problem of the whole backlight system is hard to be resolved. Moreover, in the active current balance circuit, each LED string requires a specific current balance/equalization control circuit to individually control a current of each LED string, which may increase system complexity and cost and reduce system efficiency, so that the active current balance/equalization method is not applicable when the number of the LED strings is large.

In order to overcome the defect of the active current balance circuit, passive current balance circuits composed of passive devices such as capacitors, inductors are developed, which include 1. a capacitor current balance circuit, shown in FIG. 4(*a*), which is consisted of a capacitor and two anti-parallel LED strings, wherein the capacitor and the two anti-parallel LED strings are connected in series. An input of the circuit is a high-frequency alternating current (AC) signal, and a waveform of the current flowing through each LED string is an AC half-wave, so that a maximum duty cycle of each LED string is only 50%, and only the two anti-parallel LED strings connected in series with the same capacitor can implement a good current balance/equalization effect, and the other LED strings cannot implement the current balance/equalization; and 2. a transformer current balance circuit, shown in FIG. 4(*b*), in which a primary side and a secondary side of a transformer are respectively connected to two LED strings in series to implement the current balance/equalization, though such method can only be applied in applications when the number of the LED strings is an even number.

SUMMARY OF THE INVENTION

The invention is directed to a light emitting diode (LED) backlight driving circuit with transformers for current balance, which is developed to resolve the defect of the current balance circuit of the LED driving circuit of the related art.

The LED backlight driving circuit includes an inductor, a boost switching transistor, and n LED current balance circuits, where n is the number of LED strings and is a natural number greater than 1. A first terminal of the inductor is connected to a direct current (DC) input voltage, and a second terminal of the inductor is connected to a first terminal of the boost switching transistor. A second terminal of the boost switching transistor is connected to the ground. In the n LED current balance circuits, a first LED current balance circuit includes a first current balance switch and a secondary winding of a first transformer. An input terminal of the first current balance switch is connected to the first terminal of the boost switching transistor, and an output terminal of the first current balance switch is connected to an opposite-polarity terminal of the secondary winding of the first transformer, and a common-polarity terminal of the secondary winding of the first transformer is connected to an input terminal of a first LED string. An $n^{th}$ LED current balance circuit includes an $n^{th}$ current balance switch and a primary winding of an $(n-1)^{th}$ transformer. An input terminal of the $n^{th}$ current balance switch is connected to the first terminal of the boost switching transistor, and an output terminal of the $n^{th}$ current balance switch is connected to a common-polarity terminal of the primary winding of the $(n-1)^{th}$ transformer, and an opposite-polarity terminal of the primary winding of the $(n-1)^{th}$ transformer is connected to an input terminal of an $n^{th}$ LED string. When $n>2$, $1<i<n$, and i is a natural number, an $i^{th}$ LED current balance circuit includes an $i^{th}$ current balance switch, a primary winding of an $(i-1)^{th}$ transformer and a secondary winding of an $i^{th}$ transformer. An input terminal of the $i^{th}$ current balance switch is connected to the first terminal of the boost switching transistor, and an output terminal of the $i^{th}$ current balance switch is connected to a common-polarity terminal of the primary winding of the $(i-1)^{th}$ transformer, and an opposite-polarity terminal of the primary winding of the $(i-1)^{th}$ transformer is connected to an opposite-polarity terminal of the secondary winding of the $i^{th}$ transformer, and a common-polarity terminal of the secondary winding of the $i^{th}$ transformer is connected to an input terminal of an $i^{th}$ LED string. Output terminals of all of the LED strings are connected to the second terminal of the boost switching transistor and the ground.

According to the above descriptions, passive transformers are applied in the LED driving circuit to implement current balance/equalization of the LED strings, and only n−1 small size transformers are used to implement the current balance/equalization of the n LED strings. The LED driving circuit of the invention is suitable for a system with any odd number or even number (greater than 1) of LED strings connected in parallel. Compared to the conventional active current balance method, the device number and device loss of the invention are greatly reduced, and the system cost is greatly reduced, such that the LED driving circuit of the invention is adapted to be applied to the backlight system of the large panel LCD such as the LCD TV, etc.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 4(*b*) is a principle diagram of a transformer current balance circuit.

FIG. 9(*b*) is a current simulation waveform diagram of the three LED strings with the current balance transformer.

DETAILED DESCRIPTION OF DISCLOSED EMBODIMENTS

Figure 1:
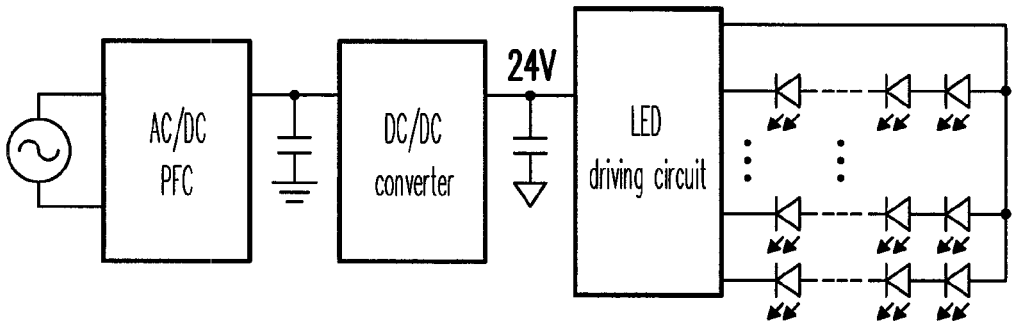
FIG. 1 (RELATED ART)
FIG. 1 is a schematic diagram of typical LED backlight source structure.
Figure 2:
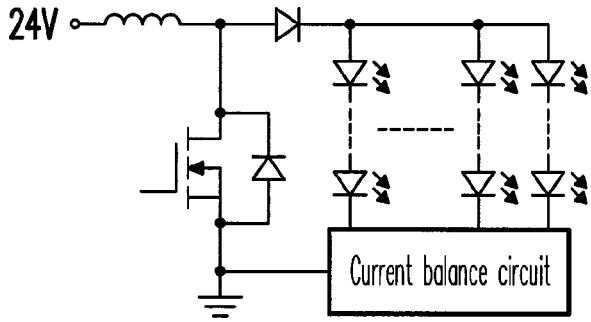
FIG. 2 (RELATED ART)
FIG. 2 is a schematic diagram of a conventional LED driving circuit.
Figure 3:
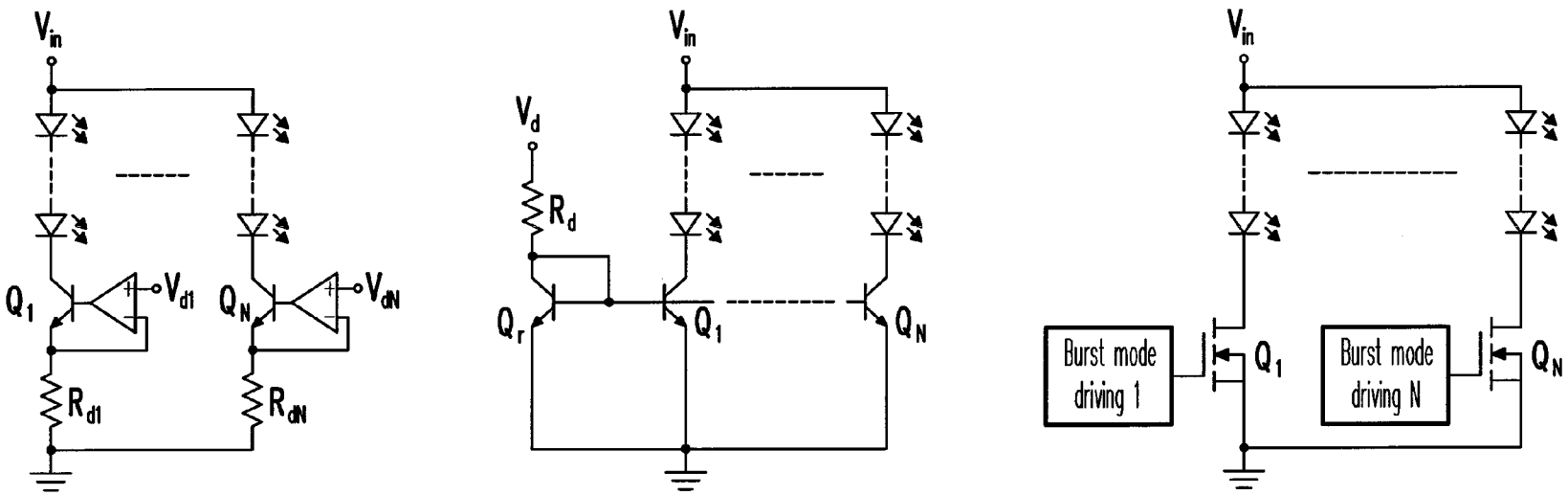
FIG. 3 (RELATED ART)
FIG. 3 is a principle diagram of three active LED current balance circuits.
Figure 4B:
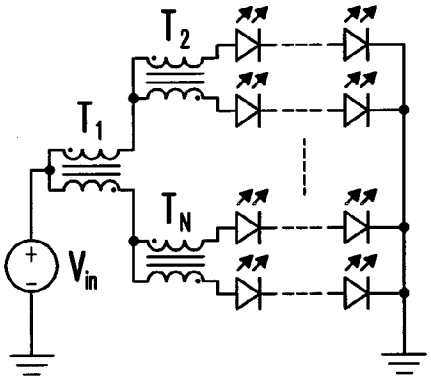
FIG. 4(b) (RELATED ART)
FIG. 4(*a*) is a principle diagram of a capacitor current balance circuit.
Figure 4A:
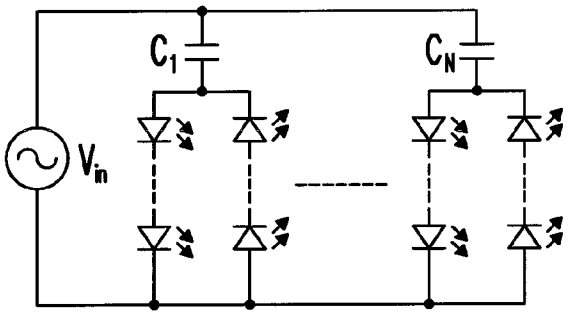
FIG. 4(a) (RELATED ART)

Reference now is made to the accompanying drawings to describe the specific embodiments and examples of the invention. Moreover, the drawings are strictly provided for an illustration purpose, and are not to be construed as limiting the scope of the invention. Wherever possible, the same reference numbers are used in the drawings and the description to refer to the same or like parts.

Figure 5:
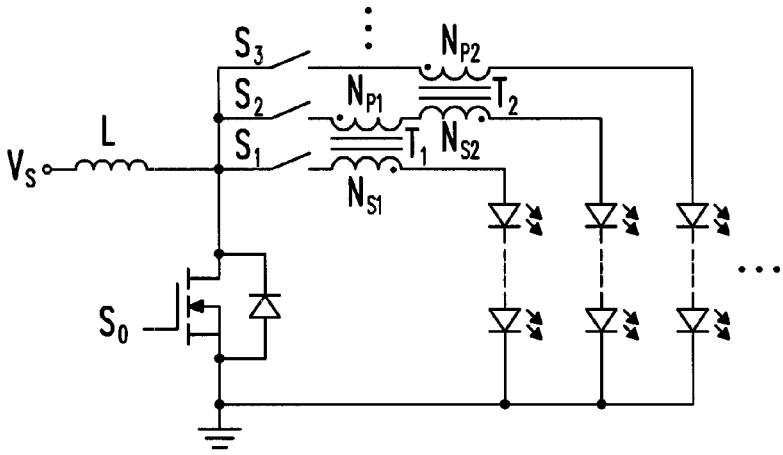
FIG. 5 is a principle diagram of a circuit according to an embodiment of the invention.

A light emitting diode (LED) backlight driving circuit of the invention is shown in FIG. 5, which is consisted of a boost circuit and transformer current balance circuit. The boost circuit of constant current control provides a total current required by all of LED strings, and the transformer current balance circuit is used to implement automatic current match of the LED strings. In FIG. 5, $V_s$ is a DC voltage (input voltage); L is an inductor; $S_0$ is a boost switching transistor; $S_1$~$S_3$ are respectively a first to a third current balance switches; $T_1$ and $T_2$ are respectively a first and a second transformers; $N_{P1}$ and $N_{S1}$ are respectively a primary winding and a secondary winding of the first transformer $T_1$; $N_{P2}$ and $N_{S2}$ are respectively a primary winding and a secondary winding of the second transformer $T_2$.

According to FIG. 5, the circuit structure includes the inductor L, the boost switching transistor $S_0$, and n LED current balance circuits, where n is the number of LED strings and is a natural number greater than 1. A first terminal of the inductor L is connected to a direct current (DC) input voltage $V_s$, and a second terminal of the inductor L is connected to a first terminal (i.e. drain) of the boost switching transistor $S_0$, and a second terminal (i.e. source) of the boost switching transistor $S_0$ is connected to the ground. In the n LED current balance circuits, a first LED current balance circuit includes a first current balance switch $S_1$ and a secondary winding $N_{S1}$ of a first transformer $T_1$. The first current balance switch $S_1$ may be implemented by a transistor, accordingly, an input terminal (i.e. drain) of the first current balance switch $S_1$ is connected to the drain of the boost switching transistor $S_0$, and an output terminal (i.e. source) of the first current balance switch $S_1$ is connected to an opposite-polarity terminal of the secondary winding $N_{S1}$ of the first transformer $T_1$. Moreover, a common-polarity terminal of the secondary winding $N_{S1}$ of the first transformer $T_1$ is connected to an input terminal of a first LED string. An $n^{th}$ LED current balance circuit includes an $n^{th}$ current balance switch $S_n$ and a primary winding $N_{Pn-1}$ of an $(n-1)^{th}$ transformer $T_{n-1}$. Similarly, the $n^{th}$ current balance switch $S_n$ may be implemented by a transistor, accordingly, an input terminal (i.e. drain) of the $n^{th}$ current balance switch $S_n$ is connected to the drain of the boost switching transistor $S_0$, and an output terminal (i.e. source) of the $n^{th}$ current balance switch $S_n$ is connected to a common-polarity terminal of the primary winding $N_{Pn-1}$ of the $(n-1)^{th}$ transformer $T_{n-1}$. Moreover, an opposite-polarity terminal of the primary winding $N_{Pn-1}$ of the $(n-1)^{th}$ transformer $T_{n-1}$ is connected to an input terminal of an $n^{th}$ LED string. When $n>2$, $1<i<n$, and i is a natural number, an $i^{th}$ LED current balance circuit includes an $i^{th}$ current balance switch $S_i$, a primary winding $N_{Pi-1}$ of an $(i-1)^{th}$ transformer $T_{i-1}$ and a secondary winding $N_{Si}$ of an $i^{th}$ transformer $T_i$. Similarly, the $i^{th}$ current balance switch $S_i$ may be implemented by a transistor, accordingly, an input terminal (i.e. drain) of the $i^{th}$ current balance switch $S_i$ is connected to the drain of the boost switching transistor $S_0$, an output terminal (i.e. source) of the $i^{th}$ current balance switch $S_i$ is connected to a common-polarity terminal of the primary winding $N_{Pi-1}$ of the $(i-1)^{th}$ transformer an opposite-polarity terminal of the primary winding $N_{Pi-1}$ of the $(i-1)^{th}$ transformer $T_{i-1}$ is connected to an opposite-polarity terminal of the secondary winding $N_{Si}$ of the $i^{th}$ transformer $T_i$, and a common-polarity terminal of the secondary winding $N_{Si}$ of the $i^{th}$ transformer $T_i$ is connected to an input terminal of an $i^{th}$ LED string. Output terminals of all of the LED strings are connected to the source of the boost switching transistor $S_0$ and the ground.

Figure 7:
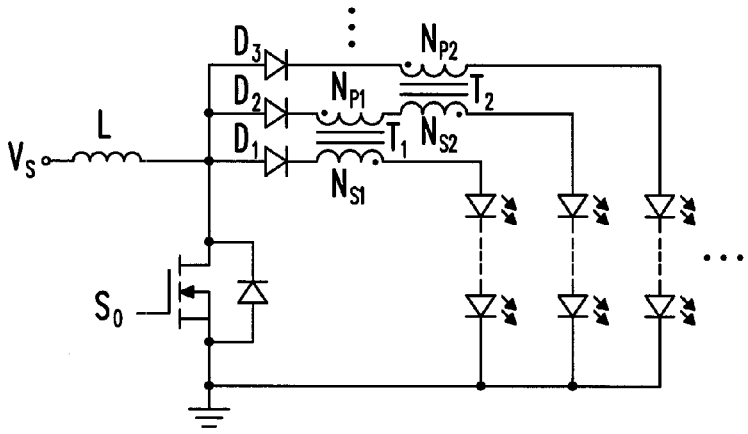
FIG. 7 is a principle diagram of a circuit according to another embodiment of the invention.

Each LED string is formed by a plurality of LEDs connected in series, and a cathode of the next LED is connected to an anode of the previous LED except for the first and last LEDs. An input terminal of each LED string is an anode of the first LED, and an output terminal of each LED string is a cathode of the last LED. In the above circuit as shown in FIG. 5, the boost switching transistor $S_0$ and the first to the $n^{th}$ current balance switches $S_1$-$S_n$ are complementarily conducted. In one embodiment of the invention, the boost switching transistor $S_0$ and the first to the $n^{th}$ current balance switches $S_1$-$S_n$ may be implemented by metal oxide semiconductor field effect transistors (MOSFETs) or insulated gate bipolar transistors (IGBTs), but not limited thereto. An emitter of the IGBT is equivalent to a source (an output terminal) of the MOSFET, a collector of the IGBT is equivalent to a drain (an input terminal) of the MOSFET. In another embodiment of the invention, the first to the $n^{th}$ current balance switches $S_1$-$S_n$ may be respectively replaced by a first to an $n^{th}$ rectifier diodes $D_1$-$D_n$, and a circuit diagram/configuration thereof is as that shown in FIG. 7, where anodes of the rectifier diodes $D_1$-$D_n$, are respectively equivalent to the input terminals of the current balance switches $S_1$-$S_n$, and cathodes of the rectifier diodes $D_1$-$D_n$, are respectively equivalent to the output terminals of the current balance switches $S_1$-$S_n$.

Since a volt-second value required for compensating a voltage variation of the LED string is very small, a small-size current balance transformer can be only used.

Figure 6:
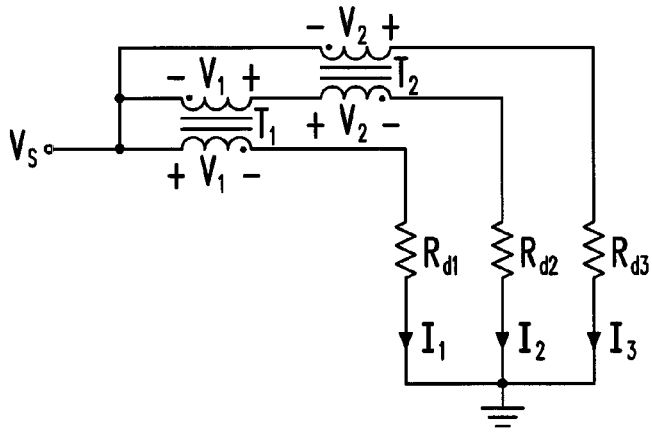
FIG. 6 is an equivalent circuit diagram for driving three LED strings according to an embodiment of the invention.

In FIG. 5, a circuit structure of driving three LED strings is illustrated (n=3). For simplicity's sake, an equivalent circuit diagram of driving three LED strings is provided in FIG. 6, in which a forward voltage drop of the rectifier diode is neglected, and the first and the second transformers $T_1$ and $T_2$ are all ideal transforms with turns ratio of 1:1. Moreover, In FIG. 6, $V_1$ and $V_2$ are respectively voltage drops of windings of the first and the second transformers $T_1$ and $T_2$; $R_{d1}$, $R_{d2}$ and $R_{d3}$ are respectively equivalent impedance of a first to a third LED strings, and $I_1$, $I_2$ and $I_3$ are respectively forward currents of the first to the third LED strings. Since the number of turns of the primary winding and the number of turns of the secondary winding of the transformer $T_1$ or $T_2$ are the same, according to a principle of the transformer, the currents flowing through the primary side and the secondary side are also the same, so as to implement the current balance/equalization of each of the LED strings. According to FIG. 6, it is obtained:

$$\begin{cases} V_s - V_1 = I_1 R_{d1} \\ V_s + V_1 - V_2 = I_2 R_{d2} \\ V_s + V_2 = I_3 R_{d3} \\ I_1 = I_2 = I_3 = I \end{cases}$$

A current of each of the LED strings after the current balance/equalization is:

$$I = \frac{3 \cdot V_s}{R_{d1} + R_{d2} + R_{d3}}$$

Voltage drops of the transformers $T_1$ and $T_2$ are respectively:

$$\begin{cases} V_1 = \dfrac{R_{d2} + R_{d3} - 2R_{d1}}{3} \cdot I \\ V_2 = \dfrac{2R_{d3} - R_{d1} - R_{d2}}{3} \cdot I \end{cases}$$

Figure 8:
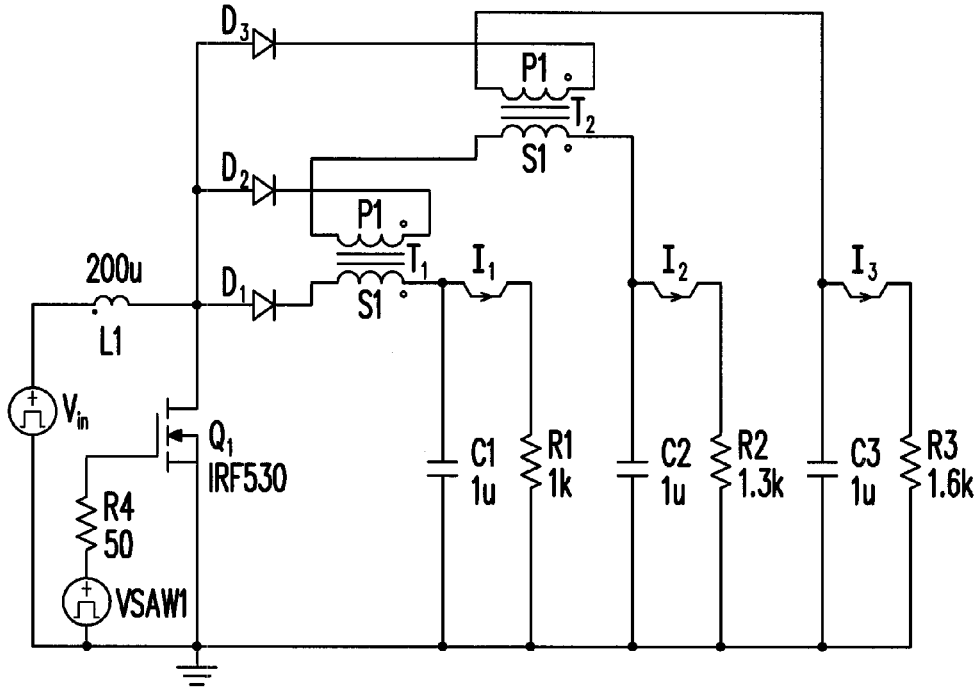
FIG. 8 is a simulation circuit for driving three LED strings according to an embodiment of the invention.

FIG. 8 is a simulation circuit for driving the three LED strings according to an embodiment of the invention, in which a magnetizing inductance of the current balance transformer is 5 mH, a coupling coefficient of the primary side and the secondary side is 0.99, and a filter capacitor connected in parallel with an LED equivalent resistance has 1 uF. According to related information of LED, it is known that a difference between an actual forward voltage drop of the LED of the same model number and a rated value thereof is about 23% in a worst case. Therefore, in the simulation circuit of FIG. 8, the equivalent resistances of the three LED strings are respectively 1 kΩ, 1.3 kΩ and 1.6 kΩ.

Figure 9A:
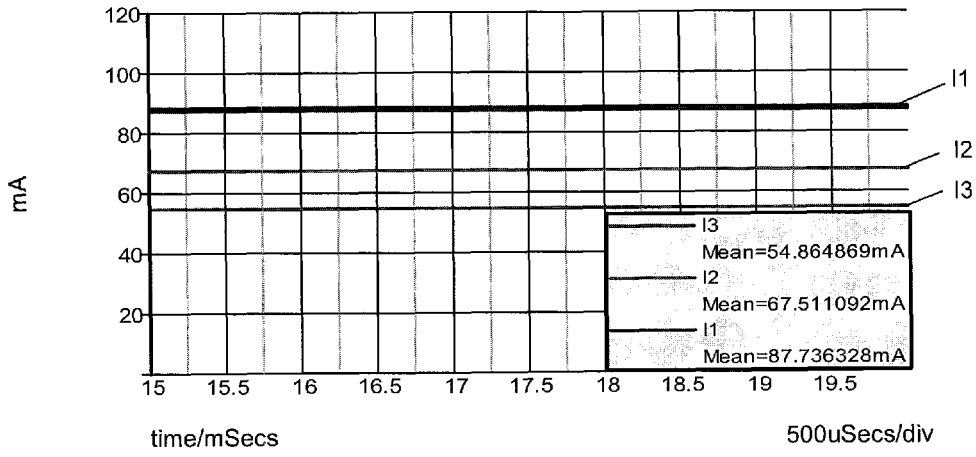
FIG. 9(*a*) is a current simulation waveform diagram of three LED strings without using a current balance transformer.
Figure 9B:
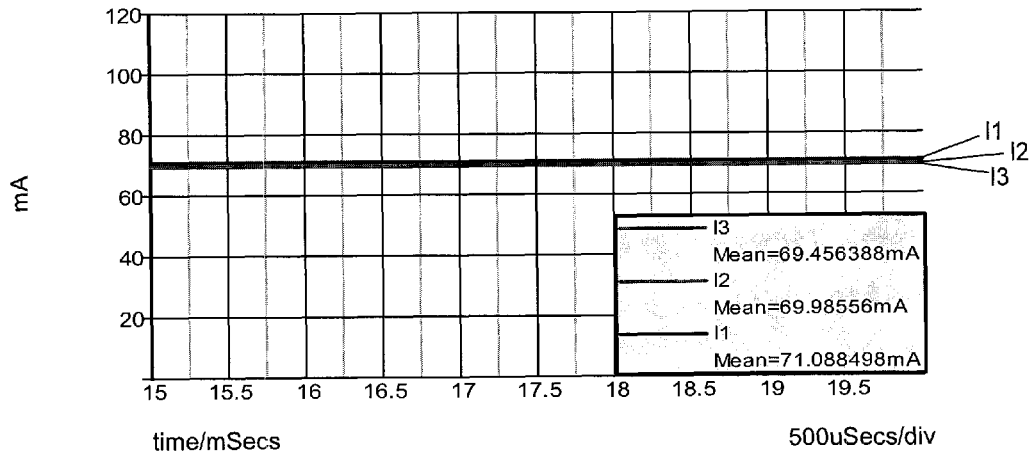

FIG. 9(*a*) and FIG. 9(*b*) are current simulation waveform diagrams of the three LED strings without/with the current balance transformer, and simulation results thereof are as that shown in Table 1 as below. According to the Table 1, it is clearly seen that after the current balance transformer is added, the accuracy of current balance is greatly improved, and by increasing the magnetizing inductance of the current balance transformer, current balance performance of the system can be improved.

TABLE 1 simulation results comparison of FIG. 5(a) and FIG. 5(b)

| | I1 | I2 | I3 | Average current | Accuracy of current balance |
|---|---|---|---|---|---|
| Without current balance transformer | 87.74 mA | 67.51 mA | 54.86 mA | 70.04 mA | ±25.3% |
| With current balance transformer | 71.09 mA | 69.99 mA | 69.46 mA | 70.18 mA | ±1.3% |

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A light emitting diode (LED) backlight driving circuit, comprising an inductor and a boost switching transistor, wherein a first terminal of the inductor is connected to a direct current (DC) input voltage, a second terminal of the inductor is connected to a first terminal of the boost switching transistor, and a second terminal of the boost switching transistor is connected to ground, and the LED backlight driving circuit further comprising:

n LED current balance circuits, wherein n is a number of LED strings, and n is a natural number greater than 1, wherein a first LED current balance circuit comprises a first current balance switch and a secondary winding of a first transformer, an input terminal of the first current balance switch is connected to the first terminal of the boost switching transistor, and an output terminal of the first current balance switch is connected to an opposite-polarity terminal of the secondary winding of the first transformer, and a common-polarity terminal of the secondary winding of the first transformer is connected to an input terminal of a $1^{st}$ LED string;

an $n^{th}$ LED current balance circuit comprises an $n^{th}$ current balance switch and a primary winding of an $(n-1)^{th}$ transformer, an input terminal of the $n^{th}$ current balance switch is connected to the first terminal of the boost switching transistor, and an output terminal of the $n^{th}$ current balance switch is connected to a common-polarity terminal of the primary winding of the $(n-1)^{th}$ transformer, and an opposite-polarity terminal of the primary winding of the $(n-1)^{th}$ transformer is connected to an input terminal of an $n^{th}$ LED string;

when $n>2$, $1<i<n$, and i is a natural number, an $i^{th}$ LED current balance circuit comprises an $i^{th}$ current balance switch, a primary winding of an $(i-1)^{th}$ transformer and a secondary winding of an $i^{th}$ transformer, an input terminal of the $i^{th}$ current balance switch is connected to the first terminal of the boost switching transistor, an output terminal of the $i^{th}$ current balance switch is connected to a common-polarity terminal of the primary winding of the $(i-1)^{th}$ transformer, and an opposite-polarity terminal of the primary winding of the $(i-1)^{th}$ transformer is connected to an opposite-polarity terminal of the secondary winding of the $i^{th}$ transformer, and a common-polarity terminal of the secondary winding of the $i^{th}$ transformer is connected to an input terminal of an $i^{th}$ LED string; and output terminals of all of the LED strings are connected to the second terminal of the boost switching transistor and the ground.

2. The LED backlight driving circuit as claimed in claim 1, wherein the first to the $n^{th}$ current balance switches are respectively replaced by a first to an $n^{th}$ rectifier diodes, and anodes of the first to the $n^{th}$ rectifier diodes are respectively equivalent to the input terminals of the first to the $n^{th}$ current balance switches, and cathodes of the first to the $n^{th}$ rectifier diodes are respectively equivalent to the output terminals of the first to the $n^{th}$ current balance switches.

3. The LED backlight driving circuit as claimed in claim 1, wherein each of the current balance switches is implemented by a transistor.

* * * * *